US006273419B1

(12) United States Patent
Allen et al.

(10) Patent No.: US 6,273,419 B1
(45) Date of Patent: Aug. 14, 2001

(54) METHOD AND DEVICE FOR SHEET COLLATION

(75) Inventors: Robert J. Allen, Danbury, CT (US); John W. Sussmeier, Cold Spring, NY (US); William J. Wright, Killingworth, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/310,217

(22) Filed: May 12, 1999

(51) Int. Cl.[7] ..... B65H 39/10
(52) U.S. Cl. ..... 271/303; 270/58.01; 270/59
(58) Field of Search ..... 271/288, 289, 271/290, 303; 270/58.8, 58.01, 59, 58.3, 52.14, 45, 46, 51

(56) References Cited

U.S. PATENT DOCUMENTS

| | | | |
|---|---|---|---|
| 4,190,241 | 2/1980 | Krueger | 270/47 |
| 4,354,671 | 10/1982 | Bergland | 270/58 |
| 4,355,795 | 10/1982 | Bergland | 270/58 |
| 4,585,113 | 4/1986 | Greenwell | 198/347 |
| 4,676,495 | 6/1987 | Hughes | 270/58 |
| 4,905,044 | 2/1990 | Hamano | 355/206 |
| 4,989,853 | 2/1991 | Matysek et al. | 270/58 |
| 5,018,720 * | 5/1991 | Whittaker et al. | 271/272 |
| 5,258,817 | 11/1993 | Acquaviva | 355/320 |
| 5,445,368 * | 8/1995 | Lester et al. | 271/303 |

FOREIGN PATENT DOCUMENTS

| | | | |
|---|---|---|---|
| 000455494A * | 11/1991 | (EP) | 271/303 |
| 405286619A * | 11/1993 | (JP) | 271/303 |

* cited by examiner

*Primary Examiner*—H. Grant Skaggs
(74) *Attorney, Agent, or Firm*—Michael J. Cummings; Christopher J. Capelli; Michael E. Melton

(57) ABSTRACT

A method and device for collating a number of sheets, serially and separately entering an entry point, into a stack at an exiting point without slowing down or pausing the sheets. The method and device, according to the present invention, provide a plurality of traveling paths with different path lengths to connect the entry point and exiting point, and use controlling devices to control the paths such that a sheet entering the entry point will travel a shorter path than the preceding sheet. It is preferred that the path length difference between any two adjacent paths is the same. The path length difference can be smaller than or equal to the length of the sheets. When the path length difference is equal to the sheet length, all sheets travel through different paths will arrive the exiting point concurrently.

9 Claims, 7 Drawing Sheets

METHOD AND DEVICE FOR SHEET COLLATION

TECHNICAL FIELD

The present invention relates generally to an inserting machine for mass mailing and, more specifically, a method and device to cause a large number of separate cut sheets to be collated into individual stacks each having a number of sheets.

BACKGROUND OF THE INVENTION

Multi-station document inserting systems are generally used by organizations such as banks, insurance companies and utility companies for producing a large volume of specific mailings where the contents of each mailpiece are directed to a particular addressee. One of the most important features of the inserting systems is speed, which is measured by the number of mailpieces that can be assembled in a given time period. A modern inserting system is expected to assemble over ten thousand mailpieces per hour. A typical inserter system includes a plurality of serially arranged stations including a sheet feeding station, a folding station and an insertion station. In general, the sheet feeder feeds one or a plurality of sheets of mailing materials to an collator, which collects the fed sheets into a predefined collated packet or stack. Mailing materials are usually printed on a continuous web of paper and the printed paper is cut into individual sheets. These sheets are then collated into individual stacks and each stack is stuffed into an envelope for mailing. One of the conventional ways of sheet collation is to slow down or stop the sheets in an impending collation at a certain point until all the sheets have arrived. This conventional method is cumbersome and inefficient because it requires a drastic change in machine speed.

It is desirable to provide a method and a device for sheet collation wherein the sheets can be kept substantially at the same speed throughout the collation process.

SUMMARY OF THE INVENTION

It is an objective of the present invention to provide a method and a device for sheet collation wherein the sheets to be collated are not required to slow down significantly or pause in the collation process.

It is another objective of the present invention to provide a method and a device for sheet collation wherein the apparatus can have a small footprint.

In sheet collation, a large number of cut sheets of flat material, such as paper, moving at a certain speed at an entry point of a machine, are gathered in an orderly fashion to become stacks at an exiting point. Each stack contains a number of sheets and the number can be fixed or varied. The sheet collation method, according to the present invention, provides a plurality of paths connecting the entry point and the exiting point, with each path having a different path length. The paths are controlled so that, for each stack of the sheets in an impending collation, a sheet entering the collator will travel a progressively shorter path than the preceding one. In other words, the first sheet travels a longer path than the second sheet, the second sheet travels a longer path than the third sheet, and so forth. The path length difference between two successive paths can be designed in accordance with the requirement in sheet stacking. If the sheets are stacked in a way that one sheet is partially overlapped with another, like the shingle pattern on a rooftop, then the path length difference between two successive paths is smaller than the length of the sheets. If the edges of the collated sheets in a stack are flush with each other, then the path length difference is substantially equal to the sheet length. But the path length difference can also be greater than the sheet length.

In practice, cut sheets of paper enter the collator in a serial fashion, usually from a cutting device upstream that has converted a continuous web of paper into individual sheets. The sheets are gathered or collated into individual stacks before they are stuffed into envelopes. In general, the number of provided paths in an collator is fixed, but the number of sheets in each stack can be varied. It is preferred that the collator includes means for determining the number of sheets in an impending collation. Thus, when the leading edge of the first sheet of a stack enters the entry point of the collator, there is a prior knowledge of the number of sheets to be collated resident in the device's central processor. This information is typically read from a barcode symbol on the first sheet of an impending collation at some point upstream of the collator. For example, if the number of provided paths is five and the number of sheets in a stack is three, then only the three shorter paths should be successively opened for sheet collation, with the shortest path being traveled by the third sheet. If the number of sheets in a stack in an impending collation is greater than five, then two or more smaller stacks can be collated in the collator and later combined at a point downstream of the collator.

One of the major advantages of the method and device for sheet collation, according to the present invention, is that all the sheets entering and exiting the device can be of the same speed. Furthermore, the collated sheets can be moved at the same or a higher speed, if so desired. Thus, the processing speed downstream of the collator is not impeded by the collation process.

The sheet collator, according to the preferred embodiment of the present invention, includes a plurality of turn-bars for defining the traveling paths, a plurality of flippers to control the opening and closing of the paths so that, for each stack in the impending collation, a sheet entering the entry point will travels a shorter path than the preceding one. Each flipper is connected to a push rod which is controlled by a solenoid. The collator further comprises rollers and belts for guiding the sheets through different paths to exit at the exiting point of the collator.

In the second embodiment of the present invention, the paths are defined by rollers. The opening and closing of the paths are controlled by flippers.

The invention will become apparent upon reading the description of the drawings.

DETAILED DESCRIPTION

Figure 1:
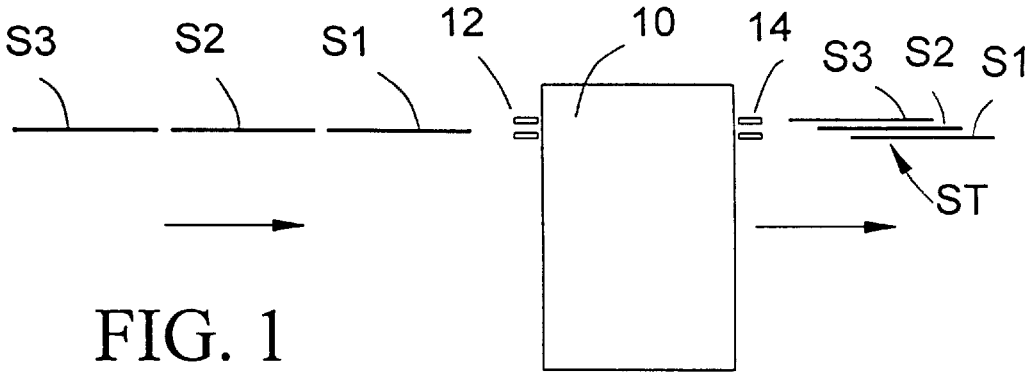
FIG. 1 illustrates the function of a sheet collator with sheets shown entering the sheet collator and after exiting the sheet collator.

FIG. 1 illustrates the function of a sheet collator. In FIG. 1, reference numeral 10 denotes a sheet collator, and S1, S2 and S3 denote three cut sheets separately and serially entering an entry point 12. As the sheets exit the exiting point 14, they are stacked up in a stack ST such that S3 is positioned on top of S2, which, in turn, is positioned on top of S1. The overlapping of a sheet on top of another can be partial as shown, like shingles on a rooftop. But the sheets can also be stacked up such that the edge of each sheet aligns evenly with the edges of the other sheets.

Figure 2:
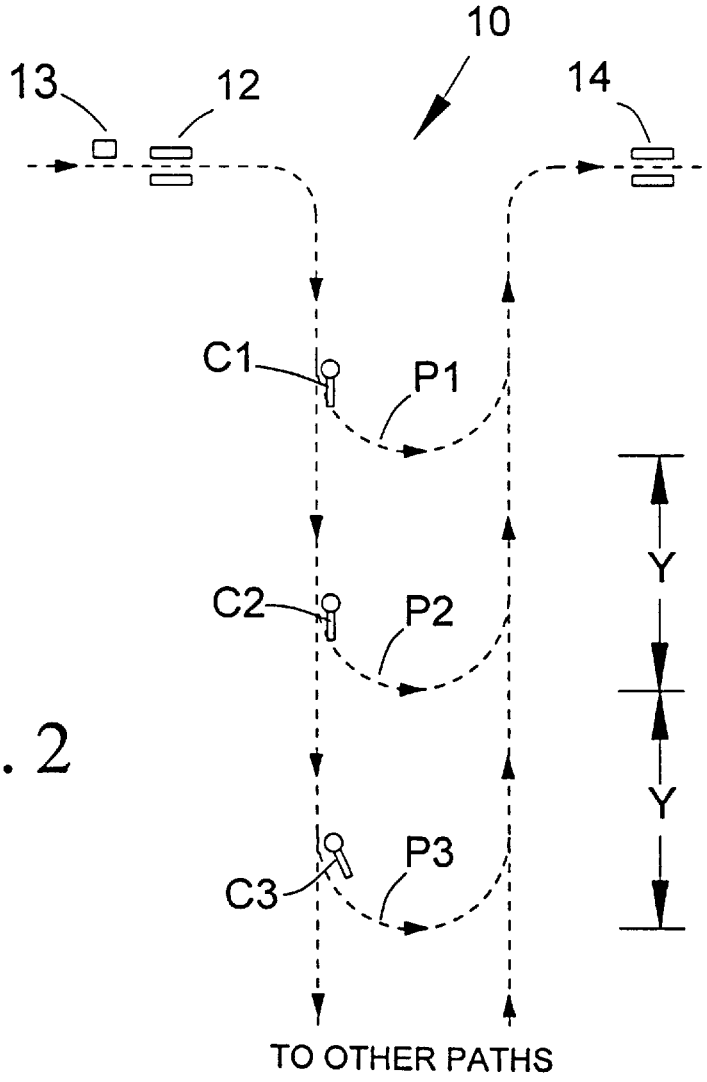
FIG. 2 illustrates the principle of sheet collation, according to the present invention.

FIG. 2 illustrates the principle of sheet collation, according to the present invention. As shown in FIG. 2, there are three or more paths connecting the entry point 12 and the exiting point 14. The first three paths are denoted by P1, P2 and P3, with the path length of path P1 being shorter than P2, P2 being shorter than P3, and so on. Associated with each path is a controlling means for opening and closing the path so that only one sheet in a stack in an impending collation is allowed to travel through the path. For example, in collating three sheets, the first sheet entering the entry point 12 will be caused to travel path P3 by keeping C1 and C2 in the closing position while C3 is in the opening position, as shown in FIG. 2. The next entering sheet will be caused to travel path P2 by keeping C1 in the closing position and C2 in the opening position. It is followed that C1 is kept in the opening position to allow the last sheet to travel along path P1. It should be noted that the path length difference between two adjacent paths shown in FIG. 2 is given by 2Y. If the length of the sheets is L, then the path length difference 2Y should be smaller than L so that the sheets are only partially overlapped with each other. But 2Y can also be equal to the sheet length L so as to allow the sheets in the impending collation to exit the collator concurrently. Moreover, it is also plausible that 2Y is greater than the sheet length L. In general, the number of provided path in an collator is fixed, but the number of sheets in each stack can be varied. Thus, it is preferred that the collator includes a sensing device 13 to determine the number of sheets in an impending collation. The sensing device can be located behind or in front of the entry point 12.

Figure 3:
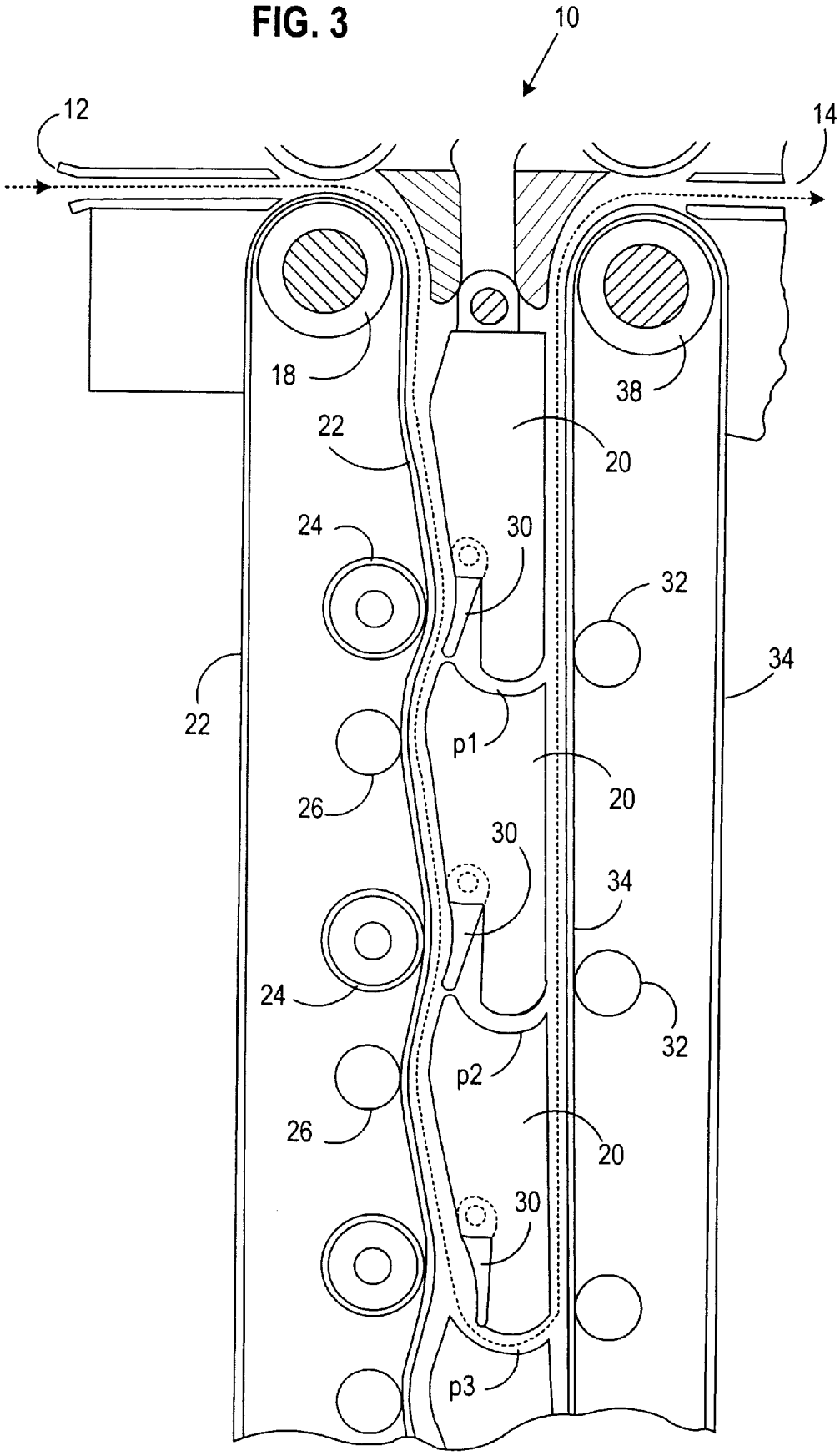
FIG. 3 illustrates the preferred method of the present invention.

FIG. 3 illustrates the preferred collation method of the present invention. In FIG. 3, a sheet collator 10 includes a number of turn-bars 20 which are positioned one above another, leaving gaps therebetween to define traveling paths. Shown in FIG. 3 are three traveling paths P1, P2 and P3, each of which is associated with a flipper 30 for opening or closing the path. As shown, the flippers associated with path P1 and path P2 are in the closing position so as to block the sheet from entering either path. The flipper associated with path P3 is in the opening position to allow a sheet entering the entry point 12 to travel along path P3 to reach the exiting point 14. The path traveled by that particular sheet is denoted by a dashed line. The sheet collator also includes power driven rollers 18 and 38, belts 22 and 34, a number of other rollers 24, 26 and 32 to guide the sheets through the collator. It should be noted that the gaps between the turn-bars and the belts are greatly exaggerated to show the traveling paths.

Figure 4A:
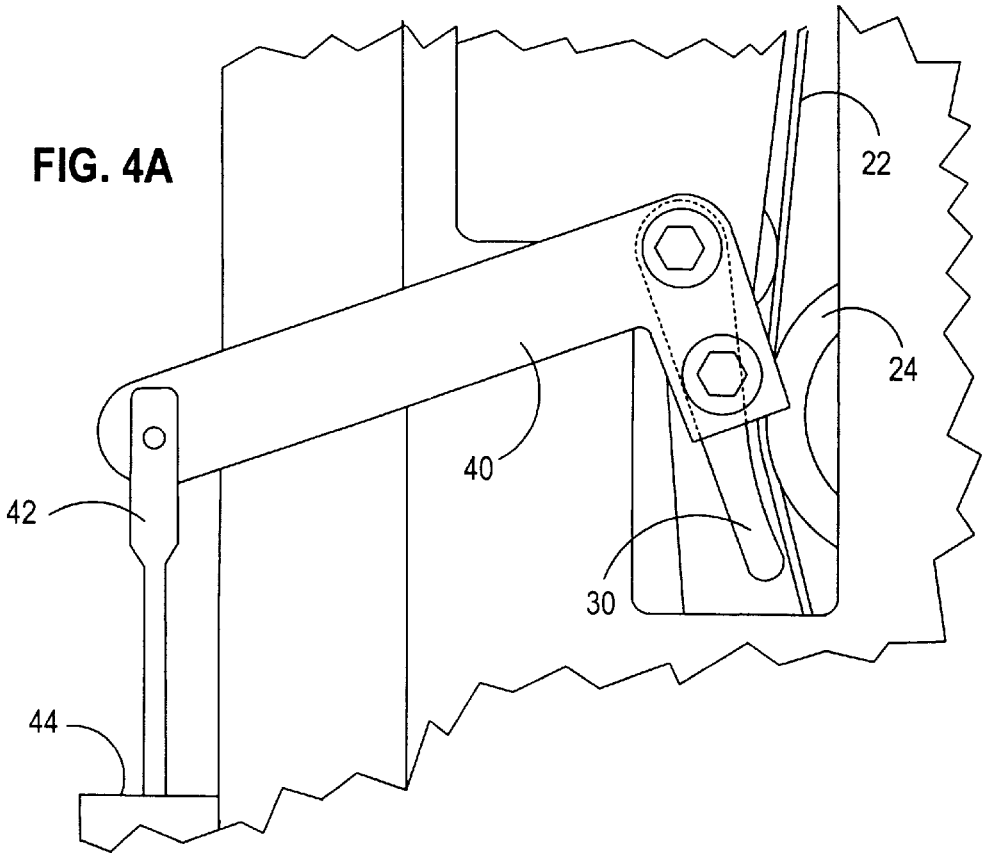
FIG. 4*a* and FIG. 4*b* illustrate the path controlling means.
Figure 4B:
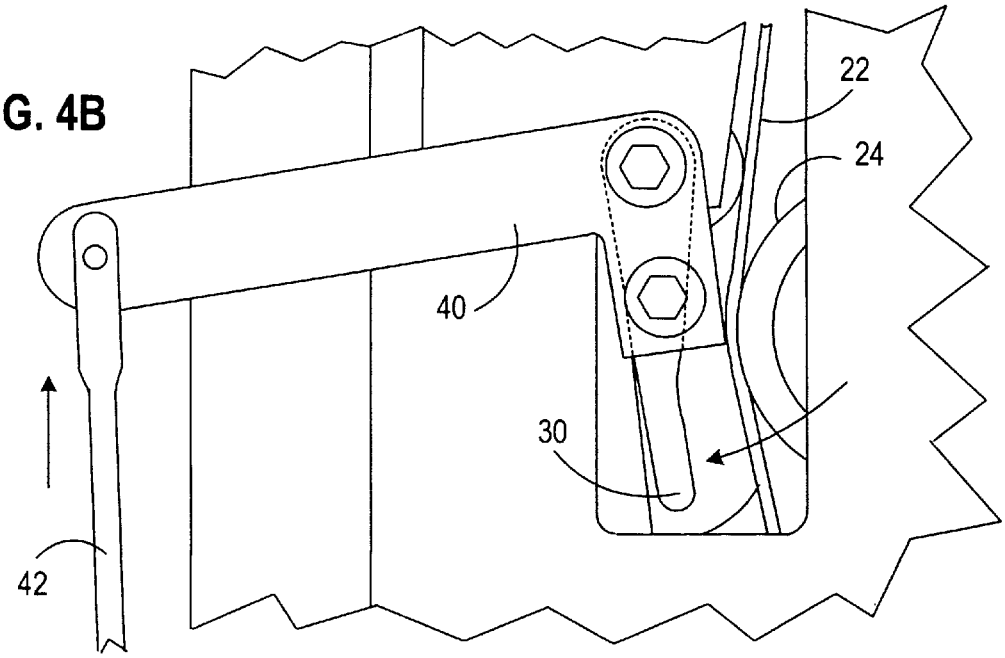

FIG. 4*a* and FIG. 4*b* show the preferred mechanism for controlling the flipper 30 associated with each path. As shown in FIG. 4*a* and FIG. 4*b,* the opening and closing of flipper 30 is caused by the action of a push rod 42 which is linked to the flipper by a lever 40. In FIG. 4*a,* flipper 30 is in a closing position, blocking a sheet from passing through the path associated with the flipper. In FIG. 4*b,* push rod 42 is shown to be pushed upward to cause flipper 30 to move inward, allowing a sheet to pass through the path. The movement of push rod 42 is caused by a pneumatic solenoid 44, an electrical solenoid, an electric rotary actuator or another actuator type mechanism.

Figure 5:
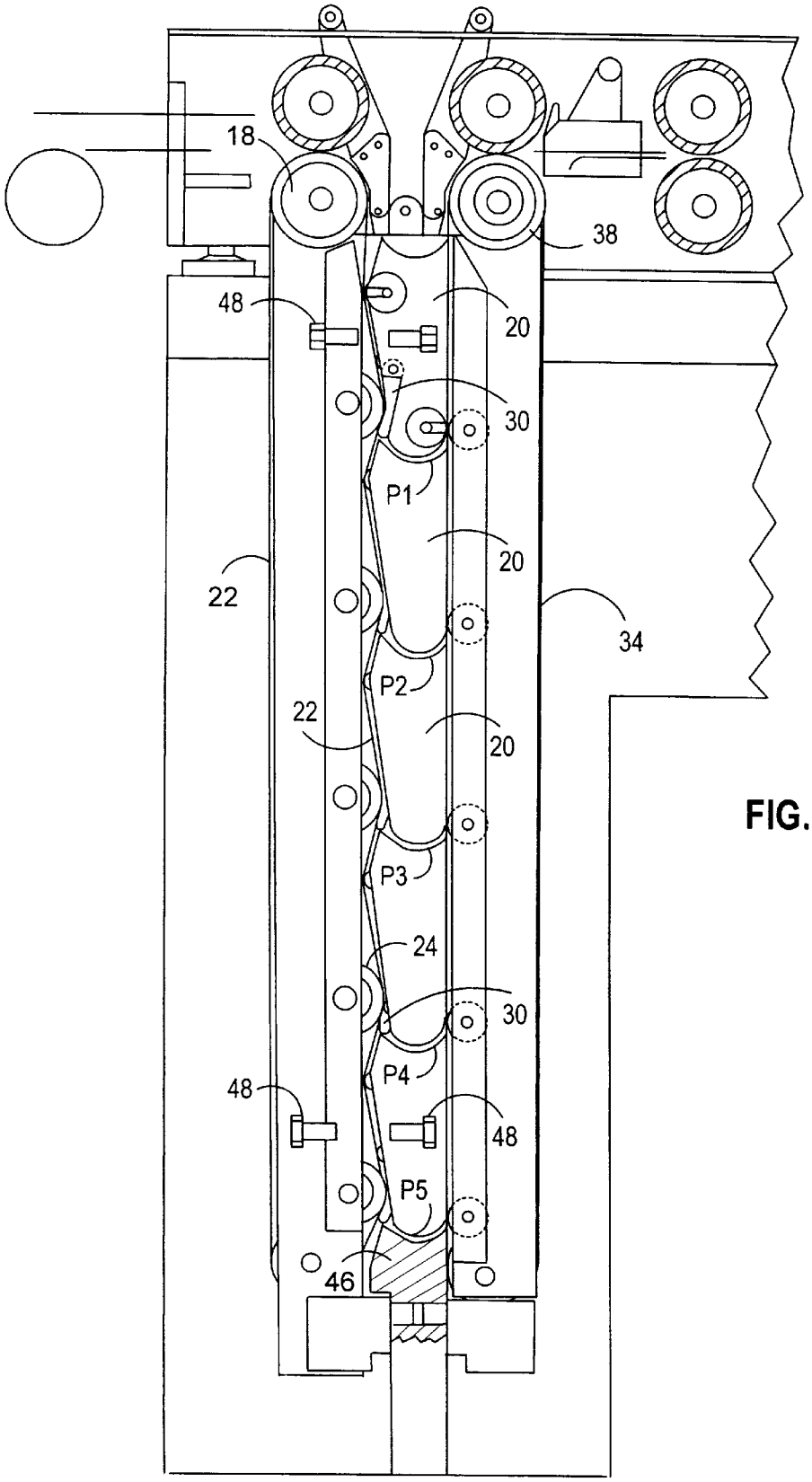
FIG. 5 illustrates a cross sectional view of the collator.

FIG. 5 illustrates a cross sectional view of the collator, according to the preferred embodiment of the present invention. In FIG. 5, there is shown a group of five turn-bars 20 being positioned one atop another to define five different paths, P1 to P5. The longest path, or P5, is defined by the lowest turn-bar and a terminating bar 46. Each of the top four turn-bars has a flipper 30 to open or close the path associated with the turn-bar. However, it is not necessary to control path P5, or the longest path, because any sheet that travels beyond path P4 must exit the collator through path P5. The collator also preferably includes a number of optical sensors, each to a turn-bar to sense the passage of the sheets. Only two optical sensors are shown in FIG. 5, denoted by reference numeral 48. It is to be appreciated that the collator depicted in FIG. 5 is to be understood as a preferred embodiment of the present invention and hence it is not to be understood to be limited to only five travel paths (P1–P5), but rather may encompass any commercially practicable number of travel, whether greater or less than five.

Figure 6:
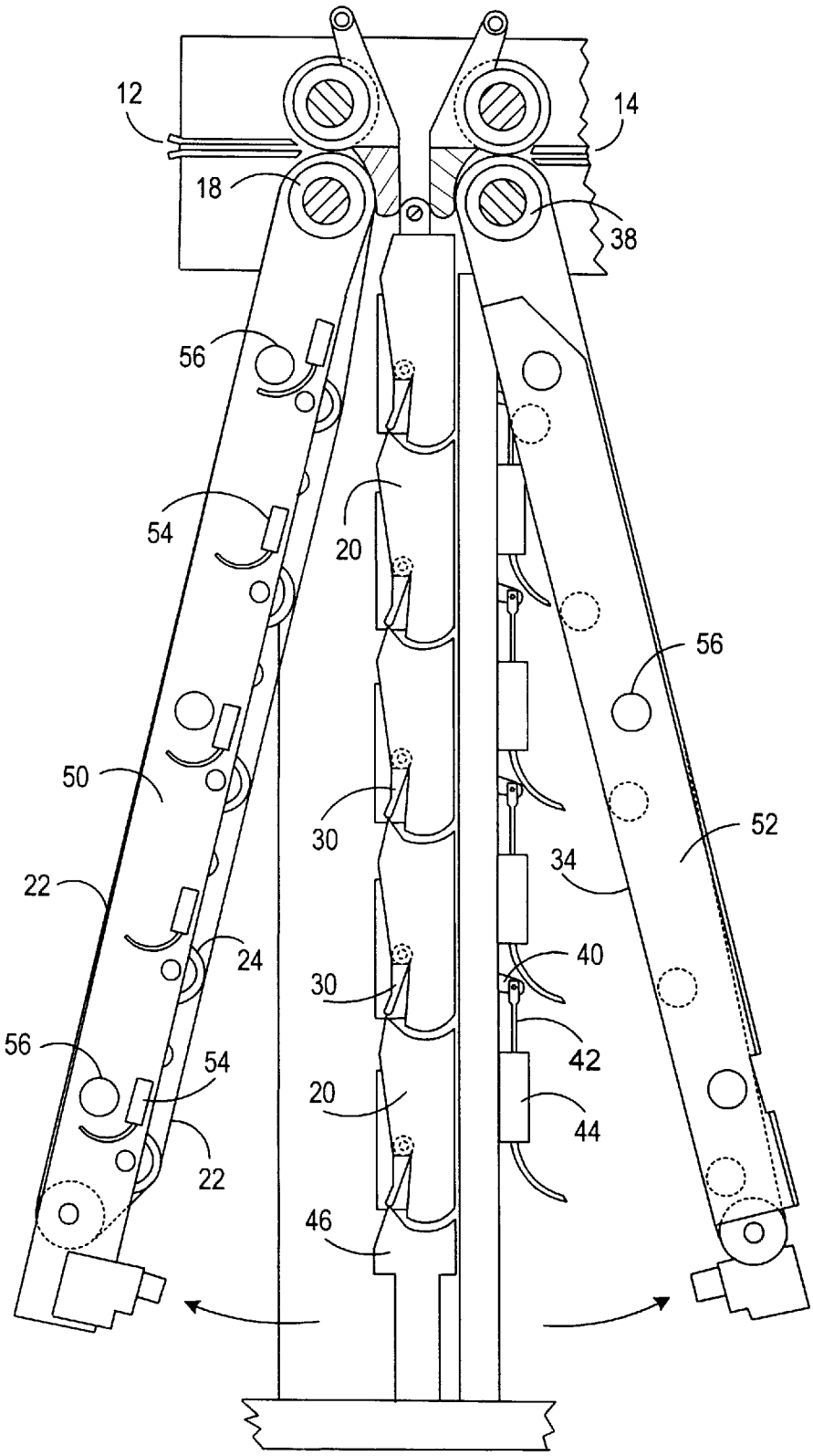
FIG. 6 illustrates another view of the collator.

FIG. 6 illustrates another view of the collator, according to the preferred embodiment of the present invention. As shown in FIG. 6, the collator has two pivotable wings 50 and 52 for installing guiding rollers and belts. To facilitate maintenance and to clear paper jam, the wings can be opened and separated from the turn-bars 30. When wing 50 is properly closed, a plurality of rollers 24 will push the belt 22 against each of the turn-bars 30 to create a paper path substantially conforming to the surface of the turn-bar as shown. Thus, when a flipper 30 is caused to move inward to open a path, a sheet encountering an opened path will be guided through the path under the turn-bar. Otherwise the sheet will travel to the next turn-bar. As wing 52 is in the opening position, the mechanism that controls the flippers 30 can be seen. As shown in FIG. 6, a number of solenoids 44, push rods 42 and levers 40 are used to control the movement of flippers 30. In FIG. 6, reference numeral 54 denotes a plurality of connectors to the optical sensors 48 shown in FIG. 5. Reference numeral 56 denotes a plurality of holding shafts which are part of the wing construction.

Figure 7:
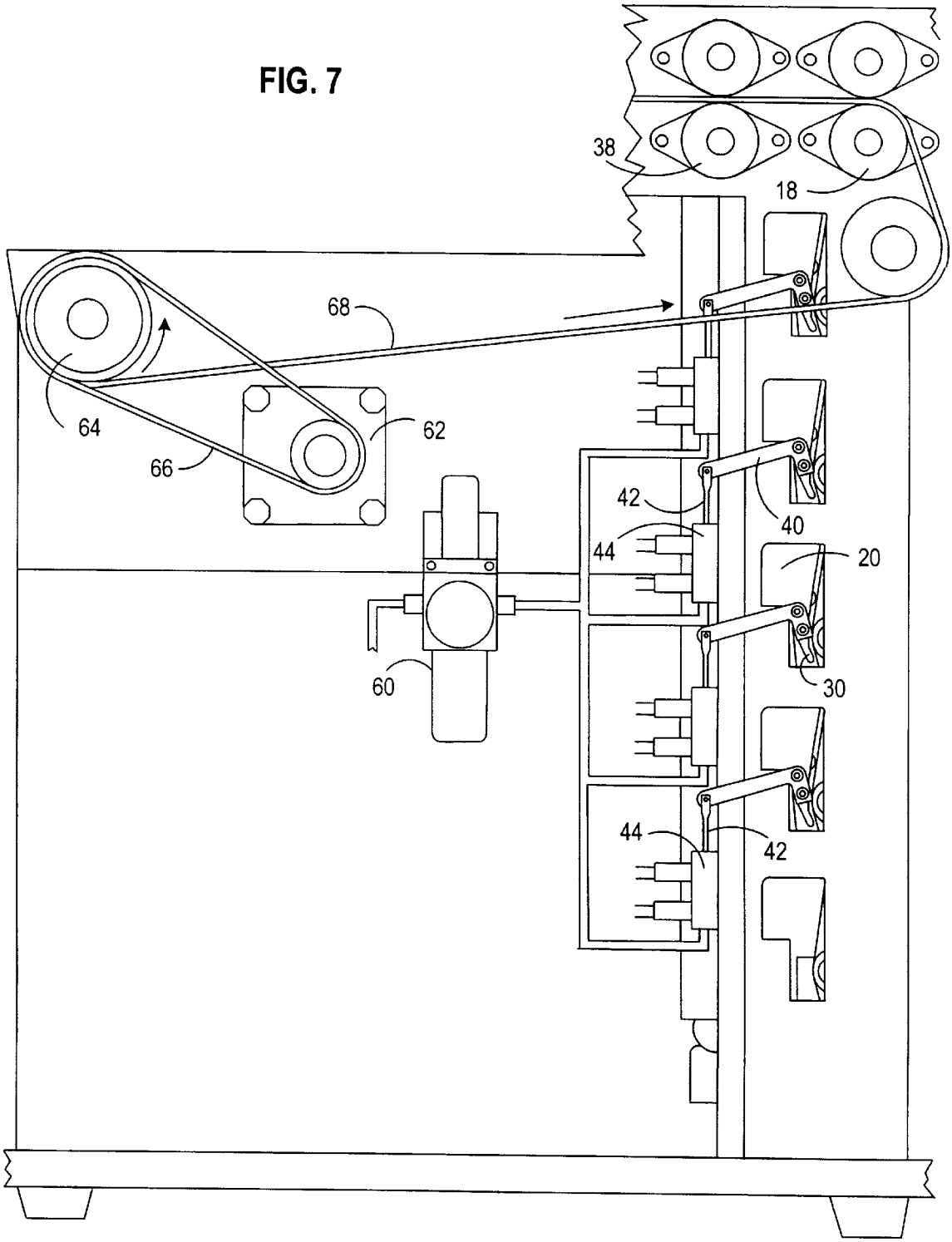
FIG. 7 illustrates yet another view of the preferred embodiment.

FIG. 7 illustrates another view of the preferred embodiment, showing the pneumatic manifold connecting solenoids 44 to a pneumatic controller unit 60. Also shown in FIG. 7 are a motor 62, a pulley system 64 and driving belts 66, 68 to drive rollers 18 and 38. With rollers 18 and 38 being driven by the same motor, sheets enter and exit the collator at the same speed. However, it is preferred that roller 38 run slightly faster than roller 18 to increase the operational efficiency. Moreover, solenoids 44 can be replaced by electric rotary actuators to control the flippers.

Figure 8:
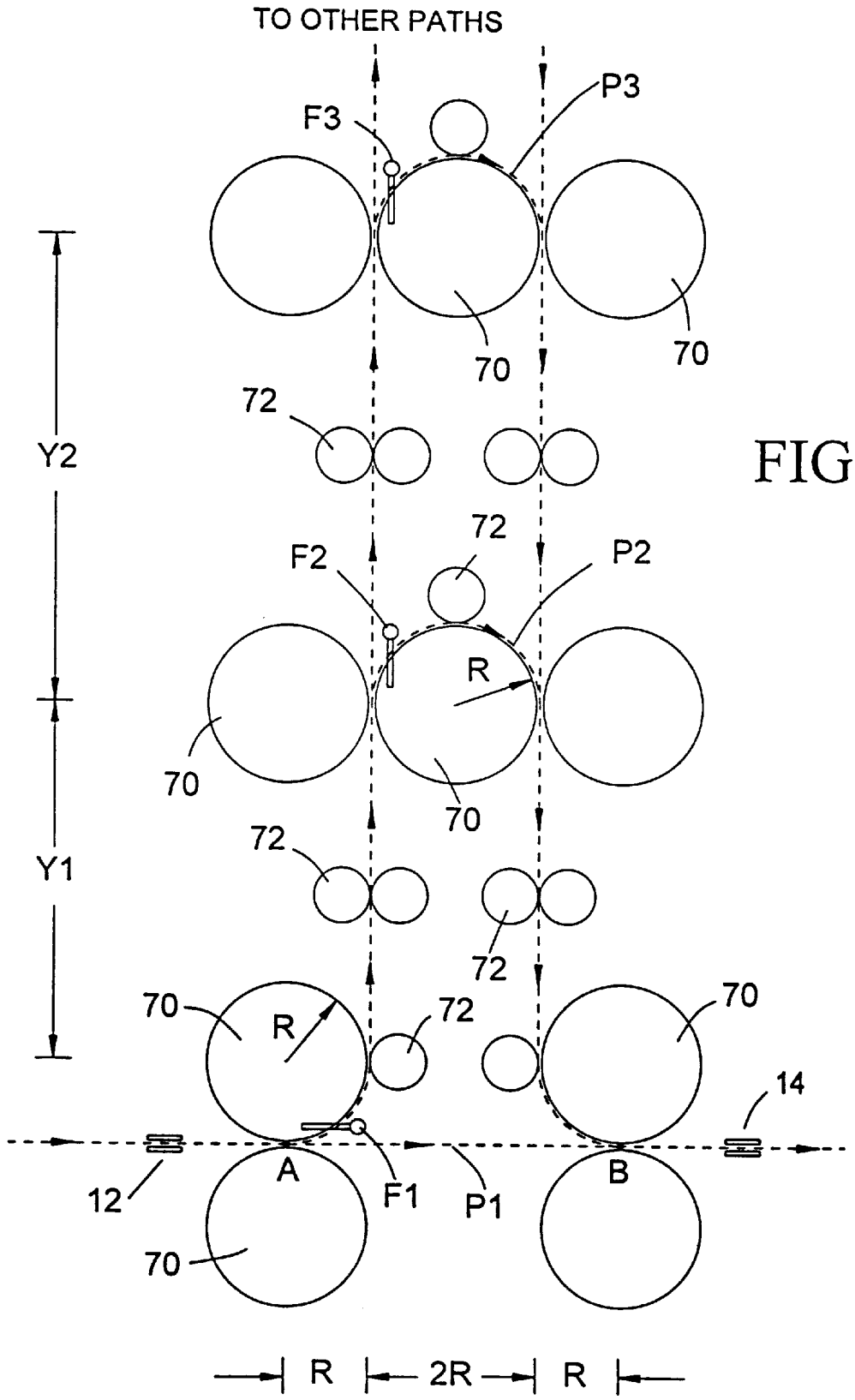
FIG. 8 illustrates the second embodiment of the present invention.

FIG. 8 illustrates another embodiment of the present invention. Like the collator shown in FIG. 5–FIG. 7, the collating device in FIG. 8 is constructed as a vertical "tower" to achieve a small footprint. As shown in FIG. 8, a plurality of rollers 70 and 72 are used to guide a plurality of cut sheets, serially and separately entering an entry point 12, to move through different paths P1, P2, P3, . . . and to exit at an exiting point 14. The opening and closing of the paths are controlled by flippers Fl, F2, F3, . . . If flipper F1 is in an opening position, a sheet entering the entry point will travel along path P1 to the exiting point. Otherwise, the sheet will be caused to move up the tower and travel through another opened path. The path length difference between two adjacent paths is determined by the spacings Y1, Y2 between rollers, and the radius R of rollers 70 as shown. It is understood that while it is shown in FIG. 8 that all rollers 70 are of the same size, it is not necessarily so. However, if all rollers 70 have the same radius R, then the path length of each path between point A and point B is given by:

$$P1=4R$$

$$P2=2Y1+2\pi R$$

$$P3=2Y1+2Y2+2\pi R$$

It is preferable to have the path length difference between any two adjacent paths being the same throughout the collator, thus, (P3−P2)=(P2−P1), or $$Y2=Y1+(\pi-2)R=Y1+1.14R$$

Assuming that the sheet length is L and it is desirable to have all the sheets traveling along different paths to arrive at the exiting point concurrently, then $$Y2=L/2$$

$$Y1=(L/2)-1.14R$$

For example, if L=18" and R=1.5", we have Y2=9" and Y1=7.29".

Although the invention has been described with respect to the preferred embodiments and methods, it will be understood by those skilled in the art that the foregoing and various other changes, omissions and deviations in the form and detail thereof may be made without depart from the spirit and scope of this invention.

We claim:

1. A device for collating a plurality of sheets wherein the sheets enter in seriatim at an entry point and become at least partially overlapped with each other at an exiting point, comprising:

a) a plurality of paths connecting the entry point and the exiting point, each path having a different path length;

b) a switching mechanism for controlling said paths so as to allow each sheet to travel a different path such that a sheet succeeding a preceding sheet of a collation entering the entry point travels a different length path than the preceding sheet;

c) a plurality of first rollers located between the entry point and the exiting point, said first rollers being arranged in rows to define paths; and d) guiding belts and second rollers for guiding the sheets through the paths.

2. A device for collating a plurality of sheets as recited in claim 1, wherein the succeeding sheet of a collation travels a shorter path length than each preceding sheet of a collation.

3. A device for collating a plurality of sheets as recited in claim 1, wherein each path has a substantially curved configuration.

4. The device of claim 1 further including a plurality of turn-bars located between the entry point and the exiting point, said turn-bars being positioned one on top of another to define the paths.

5. The device of claim 1 wherein the switching mechanism includes flippers movable at least between two positions.

6. The device of claim 5 wherein each of the flippers is controlled by a solenoid.

7. The device of claim 1 further including sensors for sensing the passage of the sheets through each path.

8. The device of claim 1 further including drive rollers for moving said guiding belts.

9. The device of claim 8 further comprising means for driving said drive rollers.

* * * * *